US011174095B1

(12) United States Patent
Schiltz

(10) Patent No.: US 11,174,095 B1
(45) Date of Patent: Nov. 16, 2021

(54) CRATE APPARATUS FOR ARTIFICIAL STONE SLABS, OR THE LIKE

(71) Applicant: Advan Packaging Systems, LLC, Columbia, SC (US)

(72) Inventor: David C. Schiltz, Columbia, SC (US)

(73) Assignee: Advan Packaging Systems LLC, Columbia, SC (US)

( * ) Notice: Subject to any disclaimer, the term of this patent is extended or adjusted under 35 U.S.C. 154(b) by 0 days.

(21) Appl. No.: 15/930,669

(22) Filed: May 13, 2020

(51) Int. Cl.

| | |
|---|---|
| ***B65D 85/46*** | (2006.01) |
| ***B65D 71/00*** | (2006.01) |
| ***B65B 5/06*** | (2006.01) |
| ***B65B 23/20*** | (2006.01) |
| ***B65D 19/18*** | (2006.01) |

(52) U.S. Cl.
CPC ..... *B65D 85/46* (2013.01); *B65B 5/06* (2013.01); *B65B 23/20* (2013.01); *B65D 19/18* (2013.01); *B65D 71/0096* (2013.01); *B65D 2519/00064* (2013.01); *B65D 2519/0081* (2013.01)

(58) Field of Classification Search
CPC ..... B65D 85/46; B65D 19/18; B65D 2519/0081; B65D 2519/00064; B65D 71/0096; B65B 5/06; B65B 23/20; B65B 23/22; B65B 27/02; A47F 7/0042
USPC ..... 206/386, 321, 322, 325, 448, 449, 562, 206/521, 589; 220/1.5; 211/41.1, 41.14
See application file for complete search history.

(56) References Cited

U.S. PATENT DOCUMENTS

| | | | |
|---|---|---|---|
| 2,358,943 | A | 9/1944 | Smith |
| 3,097,781 | A | 7/1963 | Masi |
| 3,201,026 | A | 8/1965 | Travis et al. |
| 3,660,116 | A | 5/1972 | Clark |
| 3,863,829 | A | 2/1975 | Merrill |
| 3,881,648 | A | 5/1975 | Hall |
| 5,145,067 | A | 9/1992 | Carver |
| 5,163,609 | A | 11/1992 | Muise, Jr. |
| 5,263,612 | A | 11/1993 | Nederveld |
| 5,390,847 | A | 2/1995 | Young |
| 5,458,283 | A | 10/1995 | Southwell et al. |
| 5,462,220 | A | 10/1995 | Bacchetti et al. |
| 5,503,324 | A | 4/1996 | Bacchetti et al. |
| 5,518,171 | A | 5/1996 | Moss |
| 5,642,854 | A | 7/1997 | Hatton |
| 5,658,644 | A | 8/1997 | Ho et al. |
| 5,967,662 | A | 10/1999 | Chew |
| 5,979,655 | A | 11/1999 | Tseng et al. |
| 6,079,877 | A | 6/2000 | Chew |
| 6,102,279 | A | 8/2000 | Dowd |
| 6,382,429 | B1 | 5/2002 | Yeh et al. |
| 6,481,594 | B1 | 11/2002 | Yeh et al. |

(Continued)

*Primary Examiner* — Rafael A Ortiz
(74) *Attorney, Agent, or Firm* — Additon, Pendleton & Witherspoon, P.A.

(57) ABSTRACT

A crate apparatus can at least partially contain and protect articles that may be artificial stone slabs. The crate apparatus can include a crate and one or more partitions mounted to the crate and at least partially positioned in the interior of the crate. The partitions can extend crosswise to, and be spaced apart from one another in, an upright direction. The partitions and holes therein can be cooperatively configured to at least partially define upright receptacles for respectively receiving the articles. The upright receptacles and/or articles therein can extend vertically or be in an inclined configuration.

20 Claims, 12 Drawing Sheets

(56) References Cited

U.S. PATENT DOCUMENTS

| | | | | |
|---|---|---|---|---|
| 6,759,114 | B2 | 7/2004 | Wu et al. | |
| 6,938,818 | B2 | 9/2005 | Moorman et al. | |
| 8,668,132 | B2 | 3/2014 | Lopez Masague | |
| 8,998,072 | B2 | 4/2015 | Whittles et al. | |
| 9,028,636 | B2 | 5/2015 | Frigge et al. | |
| 9,290,290 | B2 | 3/2016 | Carman | |
| 9,321,550 | B2 | 4/2016 | Whittles et al. | |
| 9,434,123 | B2 | 9/2016 | Carman | |
| 9,527,622 | B2 | 12/2016 | Carman | |
| D812,468 | S | 3/2018 | Carman | |
| 10,207,848 | B2 | 2/2019 | Alexander et al. | |
| 10,220,975 | B2 | 3/2019 | Carman | |
| 10,633,140 | B1 | 4/2020 | Vergara | |
| 10,745,190 | B2 * | 8/2020 | Moy | B65G 49/062 |
| 2004/0222542 | A1 | 11/2004 | Jan et al. | |
| 2006/0186118 | A1 * | 8/2006 | Stojak | B65D 9/12 220/4.28 |
| 2006/0026349 | A1 | 11/2006 | Whittles | |
| 2007/0045204 | A1 * | 3/2007 | Huard | B65D 85/48 211/41.14 |
| 2008/0003869 | A1 | 1/2008 | Wu et al. | |
| 2008/0003870 | A1 | 1/2008 | Wu et al. | |
| 2008/0017596 | A1 | 7/2008 | Whittles et al. | |
| 2008/0175961 | A1 | 7/2008 | Whittles et al. | |
| 2009/0250416 | A1 * | 10/2009 | Chookang | B65D 85/48 211/41.14 |
| 2011/0036904 | A1 | 2/2011 | Lopez Masague | |
| 2011/0174807 | A1 * | 7/2011 | Hadar | B65D 19/18 220/1.5 |
| 2015/0166268 | A1 * | 6/2015 | McHugh | A47F 7/0042 211/41.14 |
| 2015/0251797 | A1 | 9/2015 | Carman | |
| 2015/0329236 | A1 | 11/2015 | Deering et al. | |
| 2016/0075465 | A1 | 3/2016 | Wiley | |
| 2016/0137333 | A1 | 5/2016 | Brundage | |
| 2017/0101212 | A1 | 4/2017 | Carman | |
| 2018/0009564 | A1 | 1/2018 | Carman | |

* cited by examiner

CRATE APPARATUS FOR ARTIFICIAL STONE SLABS, OR THE LIKE

BACKGROUND

The present invention generally relates to containers for articles and, more particularly, to crates with dividers for separating artificial (e.g., simulated, manufactured, or engineered) stone slabs.

Typically numerous artificial stone slabs are contained in a single crate, and the slabs may be very sensitive to damage during shipping. For example, decorative faces of the slabs may be sensitive to surface damage such as scratches and abrasion. Such damage to the decorative face of an artificial stone slab may render the slab unusable for its decorative purpose.

It is known to protect the decorative faces of artificial stone slabs by protecting each decorative face with one or more dedicated pieces of packaging material (e.g., cushioning material). However, protecting in this manner has a relatively high packaging cost (e.g., can be labor intensive and/or require extensive use of packaging materials).

There is a desire for a solution that provides sufficient protection with less packaging cost. In one specific example of this disclosure, the solution can be applicable to artificial stone slabs.

SUMMARY

An aspect of this disclosure is the provision of a blank comprising an apertured partition that may be used in a crate or other suitable container for at least partially separating articles such as, but not limited to, artificial stone slabs, or the like. In one example, a crate apparatus includes the apertured partition positioned (e.g., suspended) in the interior of the crate, wherein: the apertured partition is configured to at least partially define a plurality of receptacles for respectively receiving the artificial stone slabs, or the like; the apertured partition is spaced apart from the crate's base in an upright direction (e.g., vertical direction); and the apertured partition extends crosswise to the upright direction (e.g., the apertured partition can extend horizontally, parallel to the ground, and/or the like).

In another example, the apertured partition can be one of a plurality of apertured partitions that are positioned (e.g., suspended) in the interior of the crate, wherein: the apertured partitions are cooperatively configured to at least partially define a plurality of upright receptacles for respectively receiving the artificial stone slabs, or the like; and the apertured partitions extend crosswise to, and are spaced apart from one another in, the upright direction. Each receptacle can be at least partially defined by respective apertures (e.g., holes optionally configured as slots) that are aligned in, and spaced apart from one another in, the upright direction.

The interior of the crate can be at least partially defined by one or more upright side structures that extend at least partially around the crate's interior. Each apertured partition can be suspended within the interior of the crate by way of mounting flaps that extend from the apertured partition and are fixedly connected to the side structures of the crate.

Each apertured partition can be made of an extruded polymeric sheet that may be in the form of a panel having elongate, interior passageways that may optionally extend in a lengthwise direction of the blank. The crate and its upright side structures (e.g., sidewalls, wall studs, posts, and/or the like) may typically be constructed of wood, although they can be constructed of other suitable materials.

An aspect of this disclosure is the provision of a crate apparatus configured to at least partially contain and protect articles that may be artificial stone slabs or other suitably configured articles. The crate apparatus can include one or more partitions at least partially positioned in the interior of a crate. The partitions can extend crosswise to, and be spaced apart from one another in, an upright direction. The partitions and holes therein can be cooperatively configured to at least partially define upright receptacles for respectively receiving the articles. The upright receptacles and/or articles therein can extend vertically or be in an inclined configuration.

A further aspect of this disclosure is the provision of an outer structure at least partially defining an interior space, and at least one partition mounted so that the partition is at least partially positioned in the interior space, wherein: the partition is spaced apart from upper and lower ends of the interior space so that respective gaps extending in an upright direction are defined between upper and lower surfaces of the partition and the upper and lower ends of the interior space; the partition extends crosswise to the upright direction; and the partition at least partially defines a plurality of upright (e.g., vertical and/or inclined) receptacles for receiving articles. The outer structure can comprise, consist essentially of, or consist of a frame, container, box, crate, and/or the like. As a non-limiting example, the partition can comprise, consist essentially of, or consist of an extruded, polymeric panel defining a plurality of interior passageways, wherein holes extend through the thickness of the panel, or the like. The partition can be one of several partitions arranged in an upright series in the interior space.

The foregoing summary provides a few brief examples and is not exhaustive, and the present invention is not limited to the foregoing examples. The foregoing examples, as well as other examples, are further explained in the following detailed description with reference to accompanying drawings.

BRIEF DESCRIPTION OF THE DRAWINGS

The drawings are provided as examples and may not be drawn to scale. The present invention may be embodied in many different forms and should not be construed as limited to the examples depicted in the drawings.

DETAILED DESCRIPTION

Examples of embodiments are disclosed in the following. The present invention may, however, be embodied in many different forms and should not be construed as limited to the embodiments set forth herein. For example, features disclosed as part of one embodiment or example can be used in the context of another embodiment or example to yield a further embodiment or example. As another example of the breadth of this disclosure, it is within the scope of this disclosure for one or more of the terms "substantially," "about," "approximately," and/or the like, to qualify each of the adjectives and adverbs of the Detailed Description section of disclosure, as discussed in greater detail below.

Figure 1:
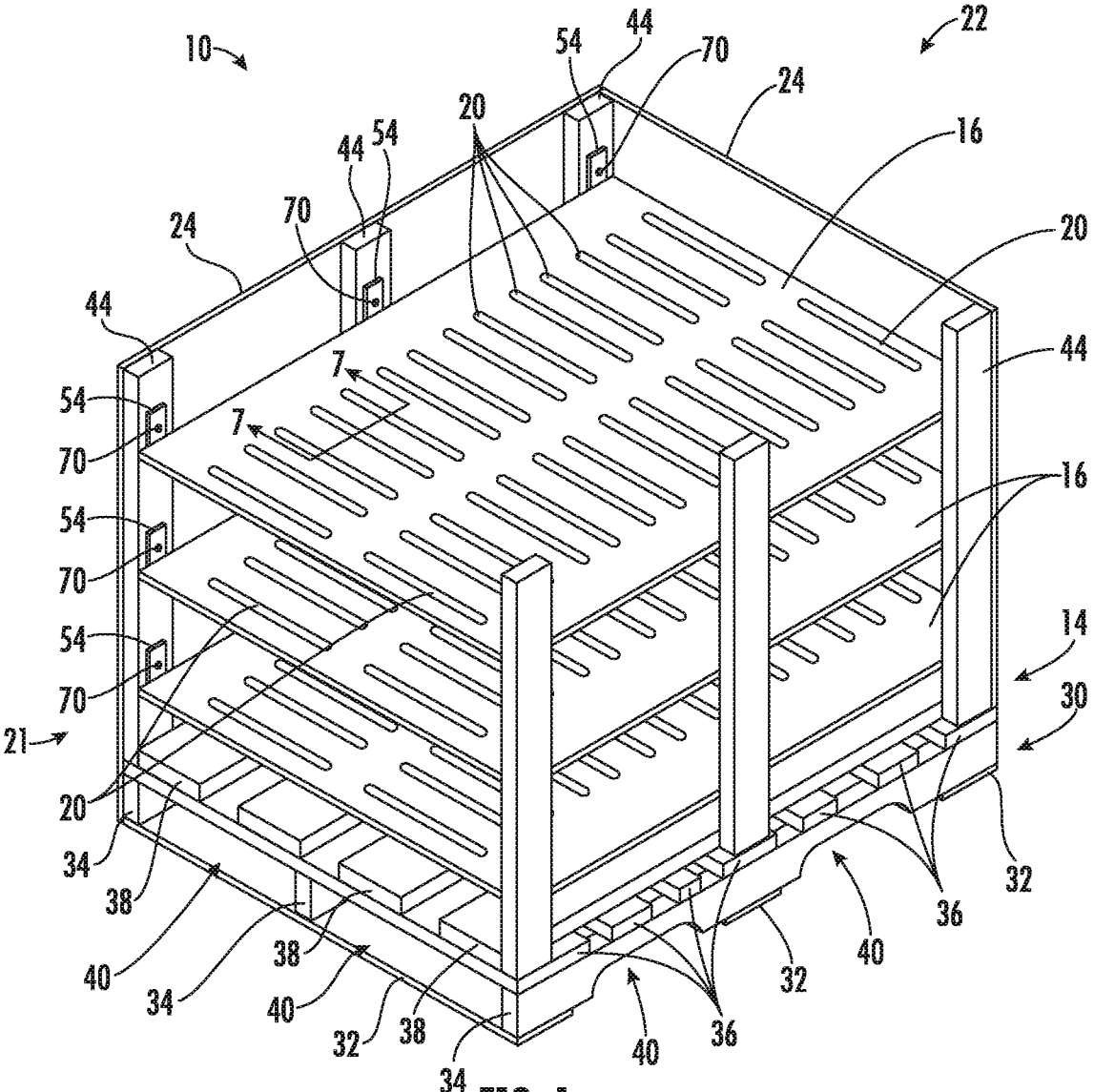
FIG. 1 is a schematic, top, front-right pictorial view of an example of a crate apparatus that can be used for shipping upright slabs, wherein portions of the crate are omitted to show apertured partitions in the crate interior, in accordance with an embodiment of this disclosure.

FIG. 1 schematically depicts aspects of an apparatus 10 that can be used in the shipping, storing, and/or displaying of a plurality of articles such as, but not limited to, artificial stone slabs 12 (FIGS. 8, 9, 11, and 12), or the like, in accordance with an embodiment of this disclosure. In the example depicted in FIG. 1, the apparatus 10 includes an outer structure in the form of a crate 14, and apertured partitions 16 mounted (e.g., suspended) in the interior of the crate. The apertured partitions 16 are configured for at least partially separating the articles, or more specifically the slabs 12, in a manner that seeks to protect them, for example by protecting decorative faces of the slabs, as discussed further below.

In the embodiments depicted in the drawings, the apertured partitions 16 define or otherwise include apertures or holes 20 (e.g., holes optionally configured as slots) that are respectively aligned to at least partially form upright (e.g., vertical or inclined) receptacles for respectively receiving uptight (e.g., vertical or inclined) slabs 12, as discussed further below. The partitions 16 can be configured in a manner that seeks to firmly yet gently hold the slabs 12 or other suitable articles in predetermined positions and prevent any damaging contact between adjacent slabs. Whereas three partitions 16 arranged in an upright series are depicted in FIG. 1, each with a predetermined number of holes 20 (e.g., 26 holes in FIG. 1, and 40 holes in FIGS. 2 and 4) the crate apparatus 10 may include a lesser or greater number of the partitions and/or holes in different configurations.

Referring to FIG. 1 for the purpose of providing a non-limiting frame of reference that may be used throughout this Detailed Description section of this disclosure for promoting ease of understanding: the crate apparatus 10 can be described as having a front 21 and a rear 22; the crate apparatus can be describe as having a length extending in a lengthwise or longitudinal direction extending from the front 21 to the rear 22; and the crate apparatus can be described as having a width extending in a crosswise direction that is crosswise to, or more specifically perpendicular to, the longitudinal direction. Whereas this frame of reference may be used for ease of understanding, its use is not intended to limit the scope of this disclosure. For example, those of ordinary skill will understand that crosswise is not limited to perpendicular, although crosswise embraces and/or encompasses perpendicular; and they will also understand that the longitudinal direction extends crosswise to the crosswise direction. In the examples depicted in the drawings, the length of the crate apparatus 10 is dimensionally greater than its width. That said and for example, the dimensions of the crate's length and width can be equal, the dimension of the crate's width can exceed that of the length, and other variations and frames of reference are within the scope of this disclosure.

In FIG. 1, portions of the crate 14 are omitted to more clearly show the partitions 16 suspended in the crate's interior. More specifically, the crate's front and right side panels 24 (FIG. 4) are omitted from FIG. 1. Also not shown at the top of the crate 14 in FIG. 1 are any top plate boards of the crate's sidewalls, or the like, as well as any lid, cover, or top closure of the crate 14.

As an example, the crate 14 can be a conventional crate of the type that is typically at least mainly constructed of wood, although it can be constructed of other suitable materials. More specifically, the crate 14 depicted in FIG. 1 is believed to be conventional per se (i.e., by itself)/not novel per se. That said, differently configured outer structures (e.g., crates 14, boxes, containers, frames, and/or the like) are within the scope of this disclosure. For example, it is believed that the one or more partitions 16 can be supported by and/or be mounted to any suitable supportive structures including any suitable base structure, frame, crate, box, fasteners, and/or the like.

In the example depicted in FIG. 1, the crate 14 includes a wooden pallet-like base 30 including lower crosswise skid boards 32, spacer blocks and/or longitudinal stringer boards 34 fixedly mounted (e.g., by way of mechanical fasteners) on top of the skid boards, crosswise lower deck boards 36 fixedly mounted (e.g., by way of mechanical fasteners) on top of the stringer boards, and longitudinal upper deck boards 38 fixedly mounted (e.g., by way of mechanical fasteners) on top of the lower deck boards. For being lifted and carried/transported, the base 30 can include longitudinal and/or crosswise receptacles 40 (e.g., horizontally extending receptacles) for receiving forks/prongs of a conventional lifting mechanism (e.g., a forklift, pallet-jack, or the like). Alternatively, the pallet-like base 30 may be a pallet formed of polymeric material (e.g., an injection-molded pallet), a pallet constructed of metallic material, or any other suitable base.

Upright side structures or sidewalls of the crate 14 can include uprights 44 in the form of upright boards (e.g., posts, upright wall studs, 2×4 boards, 4×4 boards, and/or or other suitable structures) fixedly mounted (e.g., by way of mechanical fasteners) to the base 30. The crate's sidewalls can further include the side panels 24 fixedly mounted (e.g., by way of mechanical fasteners) to the uprights 44. The side panels 24 may be constructed of corrugated cardboard, plywood, extruded polymeric panels including interior flutes or passageways, and/or any other suitable material. The uprights 44, side panels 24, and/or other features of the outer structure 14 (e.g., crate) can be constructed of wood, polymeric material, metallic material, and/or any other suitable materials.

The outer structure, crate 14, base 30, and/or associated side-structures (e.g., sidewalls, uprights 44, and/or side panels 24) can be configured in any suitable manner. For example, the base 30 can be a base plate, or the like. As another example, in some situations the side panels 24 may be omitted so that the base 30 and uprights 44 form an outer structure in the form of a frame, or the like, that at least partially defines the interior space that at least partially contains the one or more partitions 16.

Figure 2:
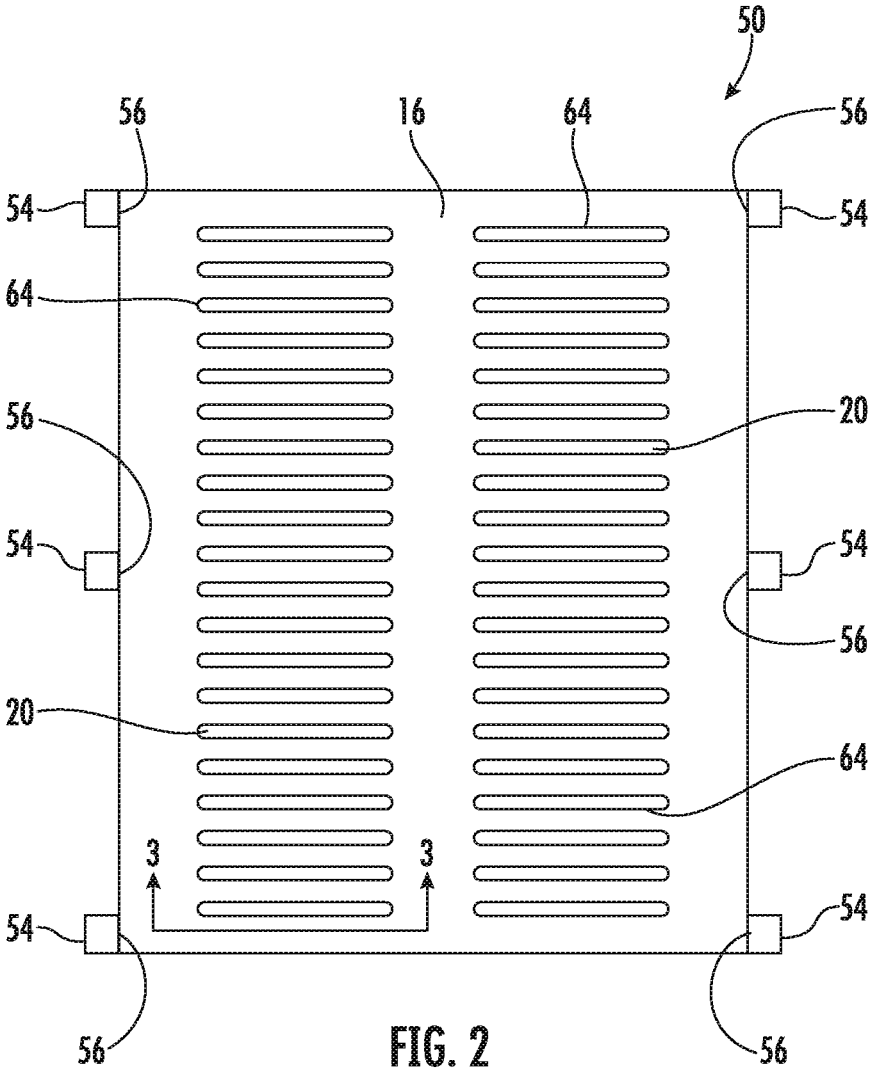
FIG. 2 is an isolated, top plan view of representative flat, unfolded blank that includes a representative apertured partition similar to the apertured partitions of FIG. 1, in accordance with an embodiment of this disclosure.

FIG. 2. depicts a representative blank 50 that includes a representative partition 16 (e.g., a central panel portion of the blank), in accordance with an embodiment of this disclosure. The apertures or holes 20 typically extend through the entire thickness of the blank's central panel portion or partition 16. At least some of, or each of, the holes 20 can be elongate, for example by virtue of having a length greater than a width. That is, the holes 20 can be in the form of rounded slots having lengths extending crosswise to the length of the blank 50 and crate 14. Alternatively, the lengths of the slots or holes 20 can extend in the longitudinal direction of the blank 50 and crate 14, and/or in any other suitable configuration. Alternatively, the holes 20 may be round, square, or in any other suitable configuration that suitably corresponds to the shape of the artificial stone slabs 12 (FIGS. 8, 9, 11, and 12) or other suitable articles to be contained in the crate apparatus 10.

In the example depicted in FIG. 2, the blank 50 further includes one or more mounting flaps 54 respectively foldably connected to opposite, longitudinal side edges of the blank's central panel portion or partition 16 by one or more lines of disruption that may be in the form of longitudinal fold lines 56, as discussed further below. Alternatively, the one or more mounting flaps 54 can be respectively foldably connected to opposite, crosswise side edges of the blank's central panel portion or partition 16 by one or more crosswise fold lines and/or in any other suitable configurations. As discussed further below, the mounting flaps 54 may be used to mount (e.g., suspend) the partition 16 in the interior of the crate 14 or other supportive structure. Additionally or alternatively, the partitions 16 may be mounted to the crate 14 in any other suitable manner, such as with mounting fixtures, mounting brackets, mounting blocks, mounting plates, support rods, and/or other suitable features, such that the mounting flaps 54 may optionally be omitted.

Figure 3:
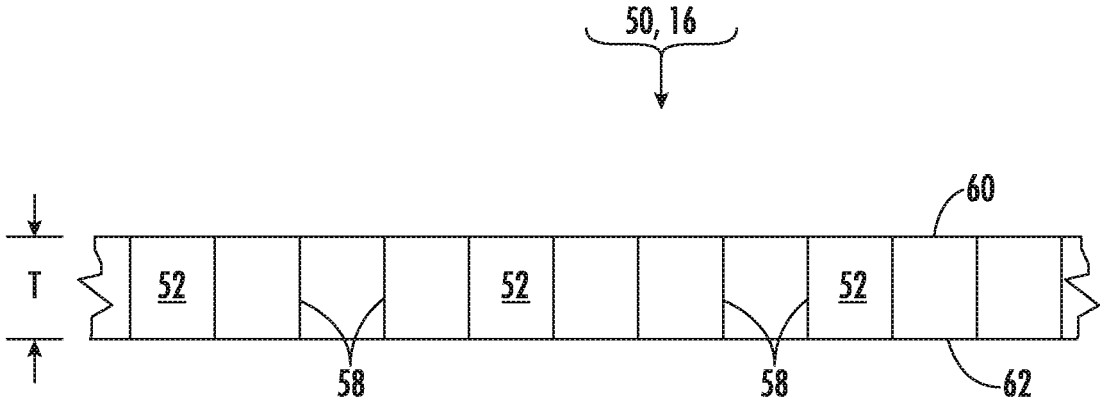
FIG. 3 is a schematic cross-sectional view of a portion of the blank of FIG. 2 taken along line 3-3 of FIG. 2, wherein the depicted cross section is perpendicular to lengthwise directions of elongate flutes or passageways in the blank, although different configurations are within the scope of this disclosure.

Referring to the cross section schematically depicted in FIG. 3, the blank 50 can be constructed from a conventional extruded polymeric sheet or panel (e.g., precursor sheet) including interior flutes or passageways 52. The polymeric precursor sheet can be cut, scored, and/or otherwise processed to form the respective features of the blank 50, as will be discussed further below. In the embodiments depicted in the drawings, the passageways 52 extend in the longitudinal (e.g., lengthwise) direction of the blank 50 and crate 14. Alternatively, the passageways 52 can extend crosswise to the length of the blank 50 and crate 14, the passageways can extend in other suitable configurations, and/or at least some of the passageways may be omitted, as discussed further below.

Referring at least partially to FIG. 3, the precursor sheets from which the blanks 50 can be formed and, thus, the blanks 50, or at least the partitions 16, can comprise, consist essentially of, or consist of an extruded, corrugated, polymeric sheet having connector webs 58 integrally formed with, connecting, and spanning crosswise (e.g., perpendicular to) opposite upper and lower walls 60, 62 of the precursor sheets, blanks 50, or partitions 16. In the embodiments depicted in the drawings, each of the elongate connector webs 58 extends in the longitudinal (e.g., lengthwise) direction of the blank 50, and the connector webs are serially spaced apart from one another in a direction extending crosswise to the longitudinal direction, so that each interior passageway 52 (e.g., flute) is defined between a pair of adjacent connector webs 58 and between respective portions of the upper and lower walls 60, 62. Alternatively, each of the elongate connector webs 58 can extend in the width-wise (e.g., crosswise) direction of the blank 50, so that the connector webs are serially spaced apart from one another in the longitudinal direction.

The precursor sheets and, thus, the blanks 50 and partitions 16 can be constructed of polypropylene of various grades and types, or any other suitable polymeric materials (e.g., including rubber-modified and/or elastomer-modified grades of polypropylene configured to both: soften the material to reduce the possibility of abrasion of the articles or slabs 12, and toughen the polypropylene to reduce the possibility of cracking or tearing of the polypropylene sheet). One or more of the interior passageways 52 can be omitted and/or configured differently, for example by being defined by wavy or undulating shapes. It is believed that suitable extruded, corrugated, polymeric sheets for forming the blanks 50 or partitions 16 of this disclosure may include any suitable multi-layer sheet configuration having cavities, chambers, compartments, and/or the like between its outer walls 60, 62, or the like. For example, the webs 58 may define wavy or undulating shapes. As another example, additional interior layer(s), walls, and/or other suitable features of the extruded, corrugated, polymeric sheets may be shaped as "bubbles" or alternating half-cups, semi-spheres, and/or form X-shaped cross-sectional patterns instead of "vertical flutes." As other examples, the polymeric sheet (from which the blanks 50 or partitions 16 may be formed) can be a corrugated polymeric sheet, or the polymeric sheet can be replaced by other suitable materials, for example paperboard or cardboard, corrugated paperboard or cardboard, plywood, and/or any other suitable material. As another example, the precursor sheet, blanks 50, and partitions 16 can comprise, consist essentially of, or consist of foamed polypropylene sheet, or the like. Optionally, the precursor sheet and/or other suitable material of the blanks 50 and/or partitions 16 can be coated and/or laminated together with one or more additional layers of suitable material.

Referring to FIG. 2, the precursor sheet(s) can be cut, and respective portions defined by the cuts can be removed so that the blank 50 includes the holes or slots 20, and the mounting flaps 54. For example, the holes 20 can be formed by creating cut-outs or chads that are removed from the resulting blanks 50. The cutting can be facilitated, for example, by thermally cutting, laser cutting, die cutting, and/or in any other suitable manner. In one specific example and optionally, the cuts that form the holes or slots 20 can be formed by way of thermal die cutting, wherein a heated platen and/or other suitable devices seal at least portions of the edges 64 of the partitions 16 that define the holes or slots 20, as discussed further below. Alternatively, the slots, or more generally the holes 20, can be formed in any suitable manner. For example, one or more of the blanks 50 or partitions 16 can comprise a lattice, lattice-like structure, and/or other suitable structure that defines the article-receiving holes (see, e.g., holes 20) in any suitable manner. For example, a lattice can be a structure including crossed strips arranged so that holes (see, e.g., holes 20) are defined between the strips.

The lines of disruption (e.g., longitudinal fold lines 56) that may be associated with (e.g., at least partially define) the mounting flaps 54 can be formed by applying mechanical pressure (e.g., crimping and/or scoring) at the line of disruption (e.g., folding to form the line of disruption), and/or by substantially simultaneously applying both heat and mechanical pressure at the line of disruption. The heat can be provided, for example, by way of heat transfer, ultrasonic energy, electron beam(s), laser beam(s), and/or any other suitable techniques. More generally, the lines of disruption 56 can be formed by applying mechanical force or pressure and/or by thermally heating in a variety of ways. Alternatively, the fold lines or lines of disruption 56 may not be formed in the flat blank 50. Rather, the lines of disruption 56 may be formed while (e.g., in response to) respective portions of the blank 50 are being folded, while the blank is being pushed into the interior of the crate 14, and/or while the blank is being mounted in the interior of the crate.

Figure 4:
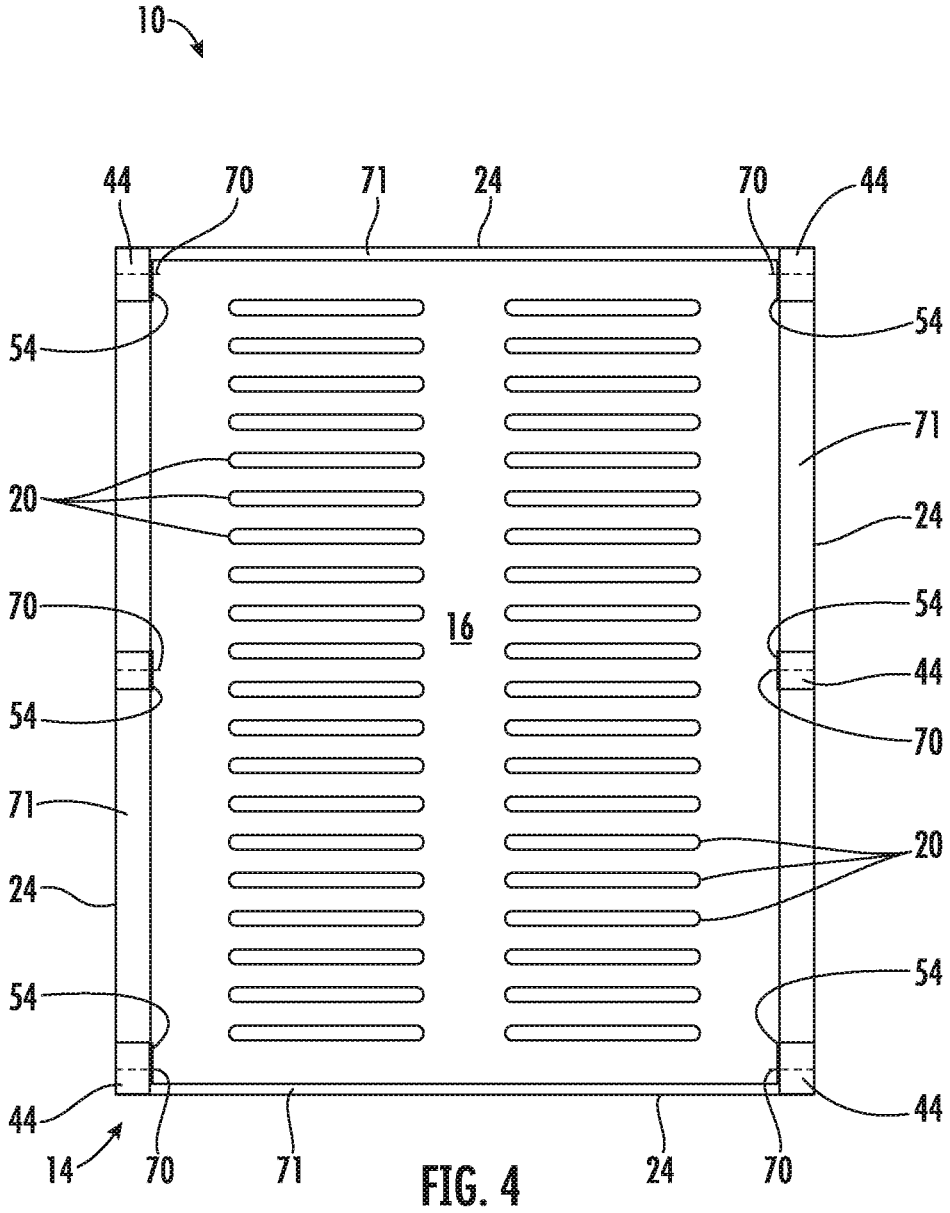
FIG. 4 is a schematic, top plan view of a crate apparatus including the crate of FIG. 1 and the apertured partition of FIG. 2, wherein FIG. 4 includes at least some of the portions omitted in FIG. 1, in accordance with an embodiment of this disclosure.

An example of a method of mounting one or more of the partitions 16 in the crate interior can be understood with reference to FIGS. 1, 2, and 4. Referring to FIG. 2, the mounting of a partition 16 in the crate interior can include there being relative pivoting or folding between the partition and the mounting flaps 54 along the lines of disruption 56. Referring also to FIGS. 1 and 4, the mounting flaps 54 can be connected to opposite sidewalls of the crate 14. More specifically, the mounting flaps 54 can be respectively connected to inner faces of the crate's uprights 44, or the like, by mechanical fasteners 70 that pierce, or extend through pre-formed holes in, the mounting flaps. The fasteners 70 can be staples, nails, screws, lag bolts, and/or any other suitable fastening mechanisms. Shanks, or the like, of the fasteners 70 are hidden from view and schematically depicted by dashed lines in FIG. 4. Additional partitions 16 can be similarly mounted in the crate 10 in series, typically starting with the lowest partition and ending with the uppermost partition. At least partially reiterating from above, alternatively, or additionally to mounting the partitions 16 by way of the mounting flaps 54, other suitable features can be used for mounting the partitions. As depicted in FIG. 4, elongate gaps 71 can be defined between the side panels 24 and the peripheral edges of the partitions 16 for ventilation, drainage, and/or ease of apparatus. Alternatively or additionally, the mounting flaps 54 and/or respective portions of the partition 16 can be directly or indirectly fastened to crate 14 in any other suitable manner, for example by being fastened to outer or other suitable surfaces of the crate's sidewalls.

Figure 5:
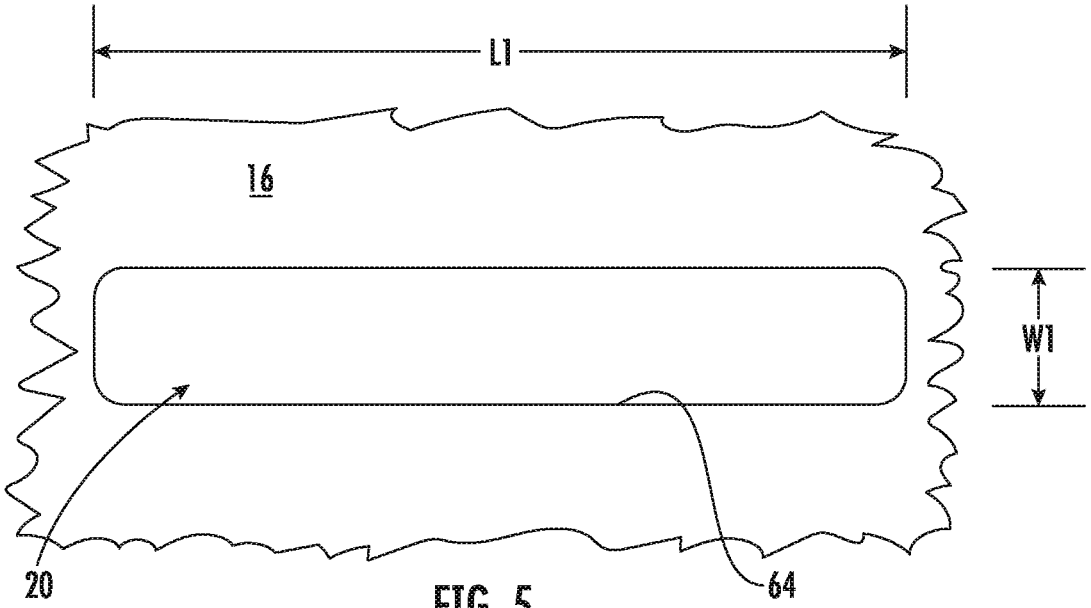
FIG. 5 is an isolated, top plan view of a representative portion of an apertured partition that includes an aperture (e.g., hole) for receiving an article (e.g., artificial stone slab), in accordance with an embodiment of this disclosure.

Referring to FIG. 5, at least some of, a majority of, or each of the holes 20 in the partitions 16 can, for example, be in the form of rectangular slots with rounded corners. Each hole or slot 20 can have first and second dimensions that extend crosswise to one another, and also extend across the slot so that the slot is configured to have at least one article (e.g., artificial stone slab 12 (FIGS. 8, 9, 11, and 12)) extend through the slot. In the example depicted in FIG. 5, the slot's first and second dimensions can be a width W1 and a length L1.

Figure 6:
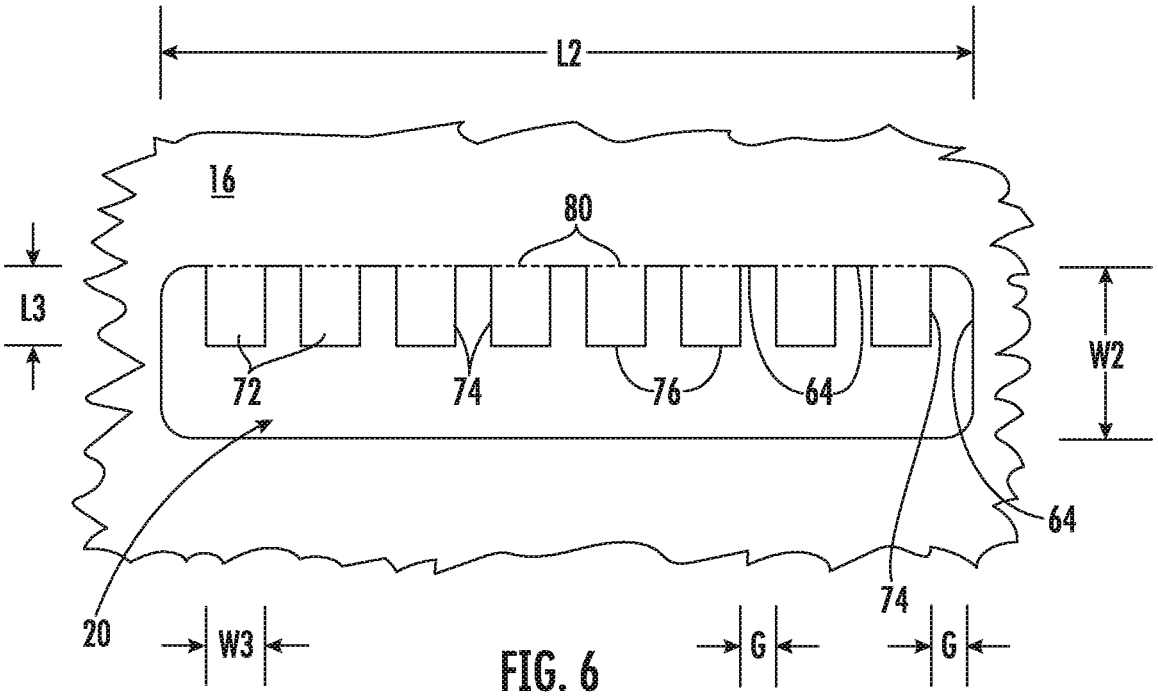
FIG. 6 is like FIG. 5, except for further depicting that, as an option, engagement flaps can extend into and/or partially define the apertures, in accordance with an embodiment of this disclosure.

Referring to FIG. 6, optionally the partitions 16 can include one or more engagement flaps 72 that protrude into, or are otherwise associated with, the holes or slots 20, so that at least some of, a majority of, or each of the holes 20 is initially at least partially obstructed by one or more engagement flaps. In the example depicted in FIG. 6, each hole or slot 20 can have first and second dimensions that extend crosswise to one another, and also extend across the slot so that the slot is configured to have at least one article (e.g., artificial stone slab 12) extend through the slot. In the example depicted in FIG. 6, the slot's first and second dimensions can be a width W2 and a length L2. At least some of, a majority of, or each of the engagement flaps 72 can be rectangular, although a variety of differently configured (e.g., shaped) partitions 16, holes 20, and flaps 54, 72 are within the scope of this disclosure. In the example depicted in FIG. 6, each engagement flap 72 has a length L3, a width W3, and gaps G are defined adjacent to the lengthwise edges 74 of the engagement flaps. In the example depicted in FIG. 6, gaps are also defined between the outer engagement flap's outer widthwise edges 74 and adjacent portions of the hole-defining edges 64. The engagement flaps 72 may be of any suitable size and shape and can be customized to specific articles 12 to balance holding the articles in place versus avoiding damage to the decorative faces 86.

At least partially reiterating from above, the edges 64, 74, 76 that define or are otherwise associated with the holes 20 can be formed, for example, by thermally cutting, laser cutting, die cutting, and/or in any other suitable manner. In one specific example and optionally, one or more of, or each of, the edges 64, 74, 76 can be relatively smooth and/or rounded as compared to an unsealed edge of the precursor sheets or panels from which the blanks 50 are typically formed. More specifically and for each partition 16, the forming of the relatively smooth and/or rounded edges 64, 74, 76 can include closing at least some of, the majority of, or each of the ends of the interior passageways 52 that would otherwise be open to the adjacent opening 20. Those ends of the interior passageways 52 can be at least partially closed or closed (e.g., hermetically sealed closed) to at least partially form sealed edges by substantially simultaneously applying thereto both heat and mechanical pressure, wherein the heating can be provided, for example, by way of heat transfer, ultrasonic energy, electron beam(s), laser beam(s), and/or any other suitable techniques.

In the example depicted in FIG. 6, portions of the hole-defining edges 64 are interrupted by the engagement flaps 72 and/or portions of the hole-defining edges 64 can be interrupted by one or more lines of disruption that may be in the form of fold lines 80 that foldably or pivotably connect the engagement flaps to respective portions of the associated partition 16. In one specific example, one or more of, a majority of, or each of the lines of disruption 80 can be a mechanically formed score line that is formed without using thermal energy, so that the engagement flaps 72 function like, or similar to, springs that are biased toward a coplanar configuration with the remainder of the associated partition 16. As discussed further below and in accordance with an example, the engagement flaps 72 can be configured to function as fingers or tabs that function as relatively small, soft springs that help to hold an associated article (e.g., artificial stone slab 12) in place within the associated hole 20, receptacle 82 (see, e.g., FIG. 7), or the like. Alternatively, the fold lines or lines of disruption 80 may not be formed in the flat blank 50. Rather, the lines of disruption 80 may be formed while (e.g., in response to) at least one article (e.g., artificial stone slab 12) is being engaged against the associated engagement flap 72 while the article is being inserted through the associated hole 20, as discussed further below.

As other examples, the lines of disruption (e.g., fold lines 80) that may be associated with (e.g., at least partially define) the engagement flaps 72 can be formed by simultaneously applying heat and mechanical pressure (e.g., crimping and/or scoring) at the line of disruption. The heat can be provided, for example, by way of heat transfer, ultrasonic energy, electron beam(s), laser beam(s), and/or any other suitable techniques. More generally, the lines of disruption 80 can be formed by applying mechanical force or pressure and/or by thermally heating in a variety of ways.

Figure 7:
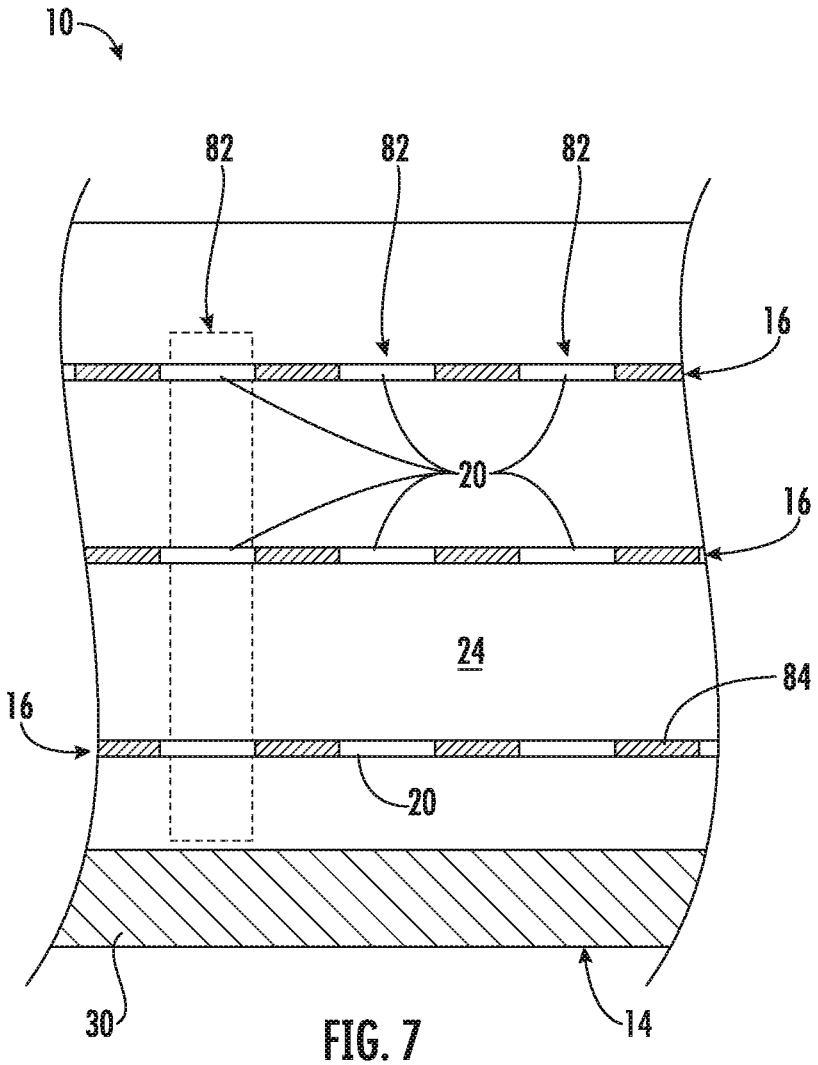
FIG. 7 is a schematic cross-sectional view of a portion of the crate apparatus taken along line 7-7 of FIG. 1, wherein a representative receptacle for receiving an article (e.g., artificial stone slab) is schematically depicted with dashed lines, in accordance with an embodiment of this disclosure.

Referring to FIG. 7, the holes 20 can be respectively aligned with one another in an upright (e.g., vertically, or inclined) direction to at least partially define receptacles 82, one of which is schematically depicted with dashed lines in FIG. 7. Lower ends of the receptacles 82 can be defined by an upper surface of the base 30, for example by being defined by upper surfaces of the longitudinal upper deck boards 38 (FIG. 1) that are configured for engaging lower ends of the articles (e.g., artificial stone slabs 12). As another example, lower ends of the receptacles 82 can be defined by one or more pieces or layers of cushioning packaging material positioned on an upper surface of the base 30 for engaging lower ends of the articles or artificial stone slabs 12, and such one or more pieces or layers of cushioning packaging material may be characterized as being a portion of the base 30. Upper ends of the receptacles 82 can optionally be defined by any lid or cover of the crate 14.

In the examples depicted in the drawings, the partitions 16 are arranged in an upright series so that gaps are defined therebetween in the upright direction, a gap is defined between the lower partition and the base 30 in the upright direction, and a gap is defined between the upper partition and an upper opening or top of the crate 14. Alternatively, the upper and lower partitions 16 can be positioned in closer proximity to the top and bottom of the crate 14, the articles 12 or slabs can protrude upwardly outwardly from an upwardly open crate, and/or other variations are within the scope of this disclosure.

Figure 8:
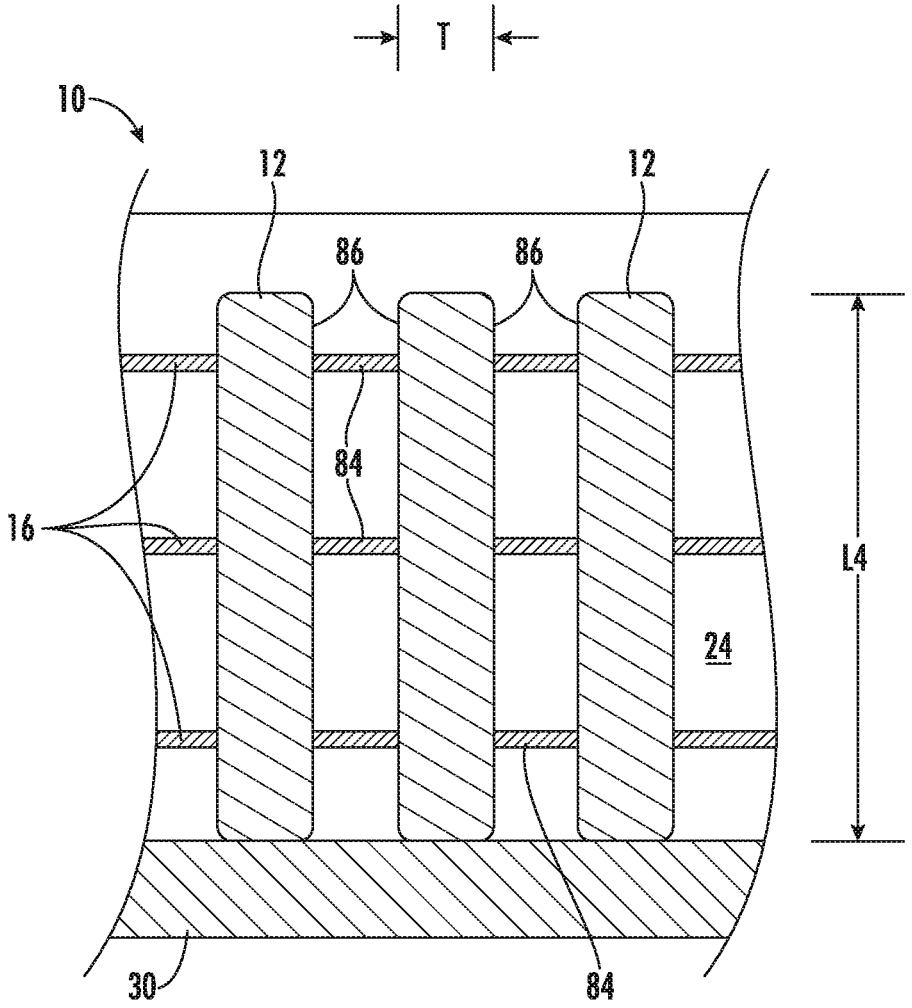
FIG. 8 is like FIG. 7, except for further depicting the articles (e.g., artificial stone slabs) in the receptacles, in accordance with an embodiment of this disclosure.
Figure 9:
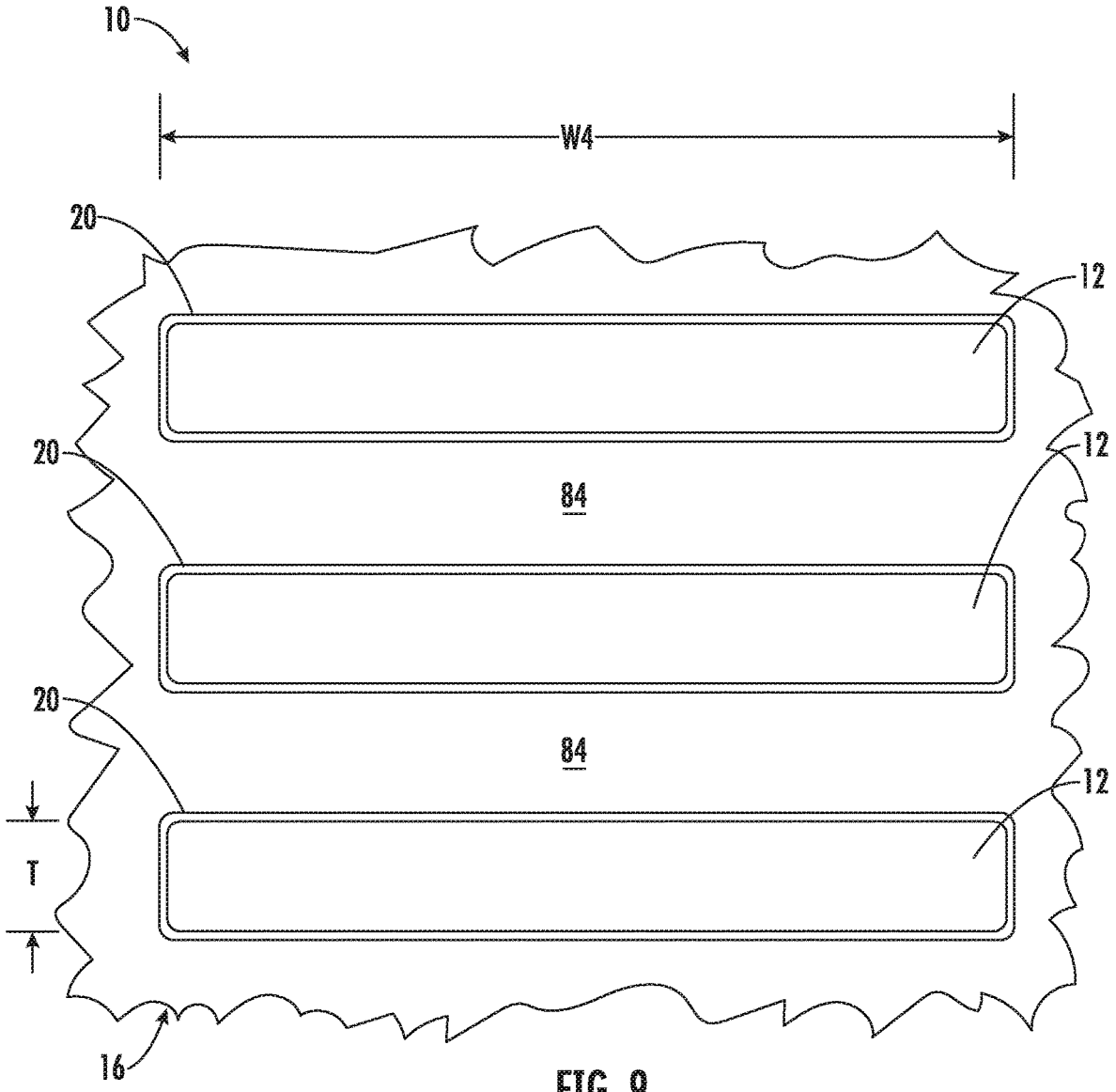
FIG. 9 is a top plan view of a portion of the crate apparatus containing the three articles depicted in FIG. 7, in accordance with an embodiment of this disclosure
Figure 10:
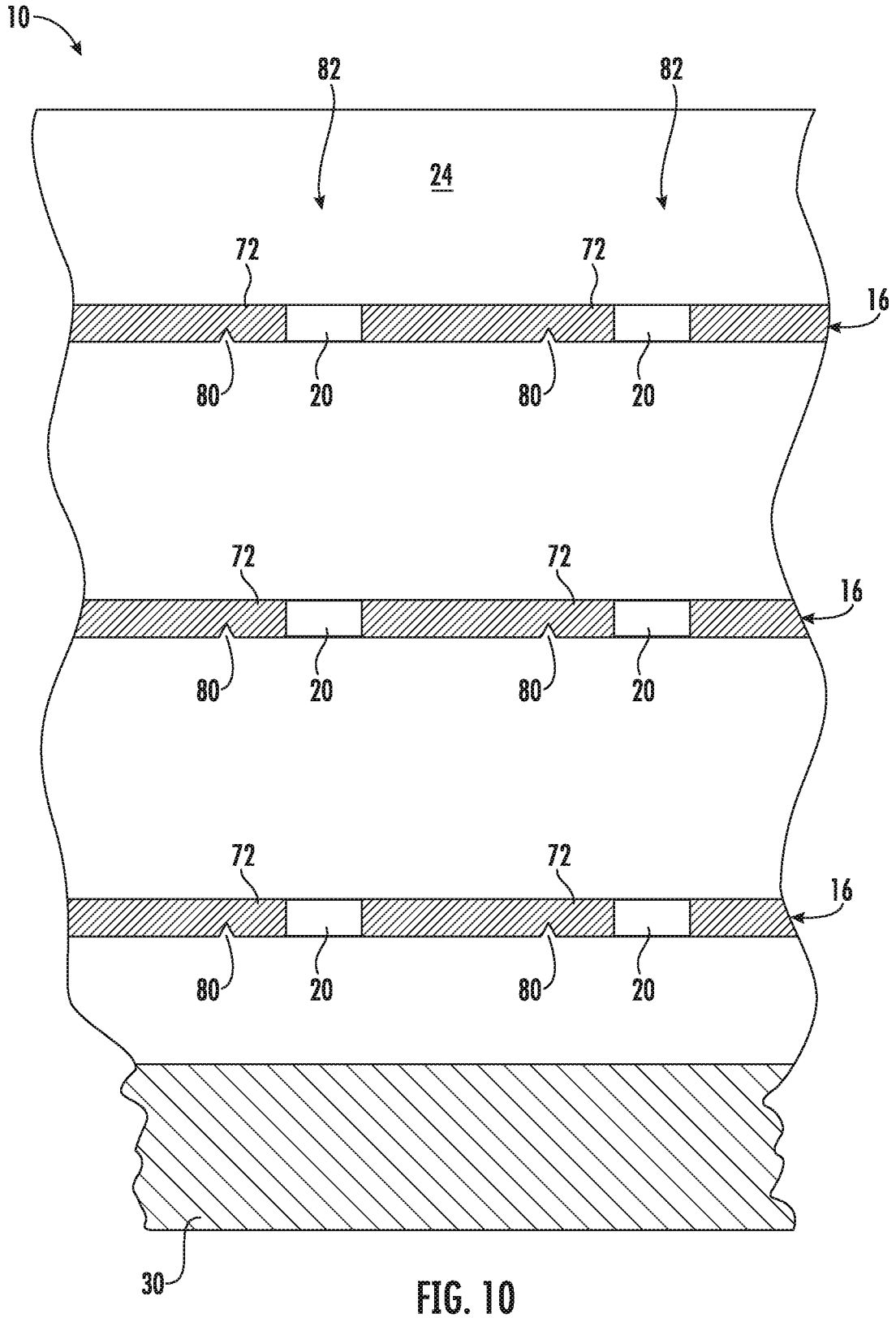
FIG. 10 is similar to FIG. 7, except, for example, for including the engagement flaps of FIG. 6, and only including two representative receptacles, in accordance with an embodiment of this disclosure.

FIGS. 8 and 9 schematically depict representative articles in the form of artificial stone slab 12 in representative receptacles 82 (see, e.g., FIG. 7). The depicted slabs 12 have lengths L4, widths W4, and thicknesses T. The partitions 16 can be configured so that portions of the partitions 16 that are adjacent (e.g., between) the holes 20 are configured (e.g., are sufficiently strong, tough, and tear resistant) to function as spacers 84 (e.g., spacer portions of the partitions 16). The spacers 84 can be configured to function in a manner that seeks to maintain a gap between faces of adjacent slabs 12 so that the slabs' decorative faces 86 are not damaged by contact with adjacent slabs.

The partitions 16 or portions thereof can be configured so that at least the portions of the partitions that come into contact, or may come into contact with, the decorative faces 86 are formed from a material that is less hard than the decorative faces, which seeks to avoid damaging the decorative faces. For example, one or more of, or each of, the edges 64, 74, 76 and engagement flaps 72 can be less hard than the decorative faces 86. Additionally and at least partially reiterating from above, at least some of, a majority of, or each of the edges 64, 74, 76 can optionally be relatively smooth and/or rounded in a manner that seeks to avoid damaging the decorative faces 86.

Figure 11:
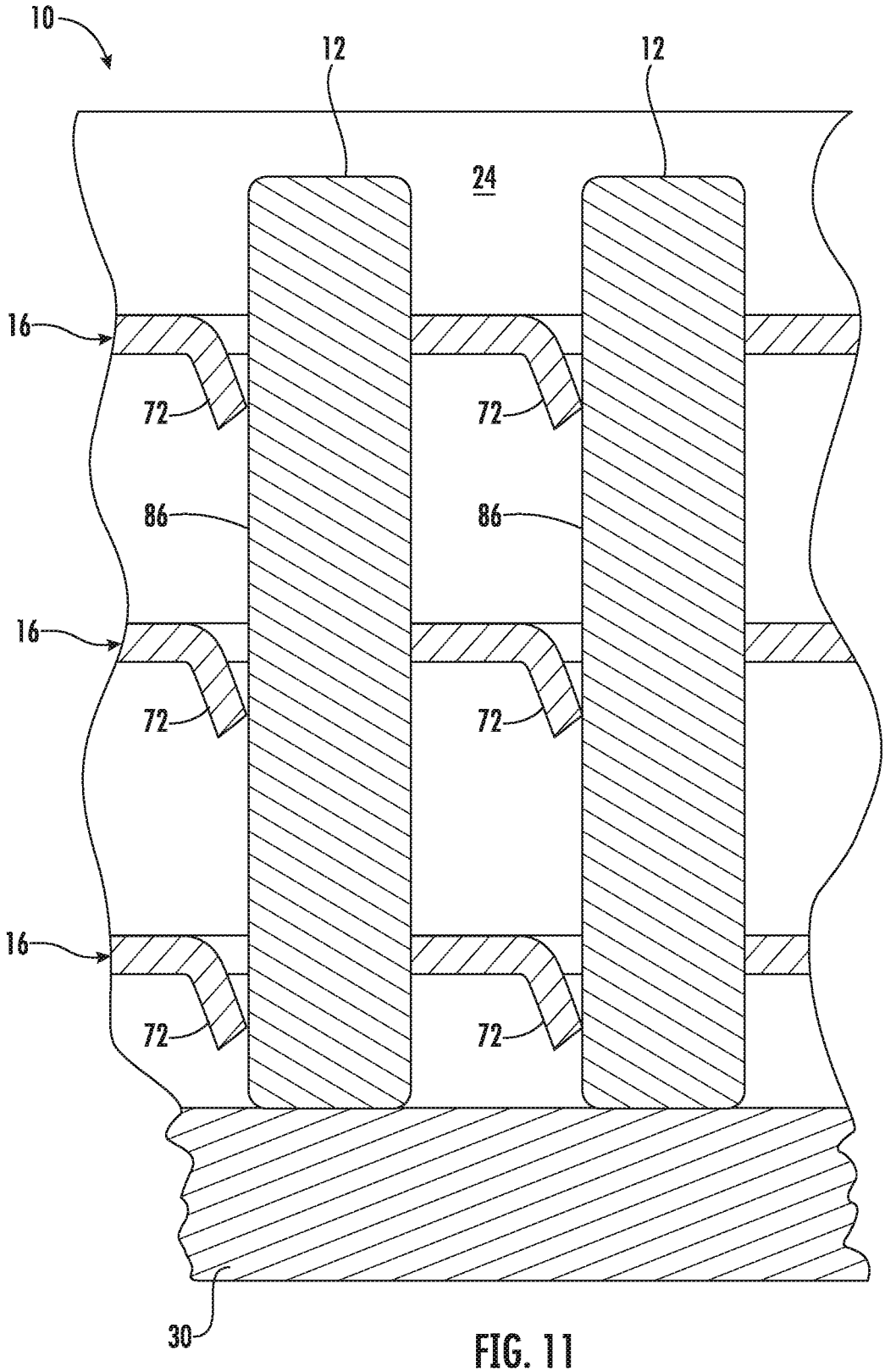
FIG. 11 is like FIG. 10, except, for example, for further depicting articles (e.g., artificial stone slabs) in the receptacles, in accordance with an embodiment of this disclosure.
Figure 12:
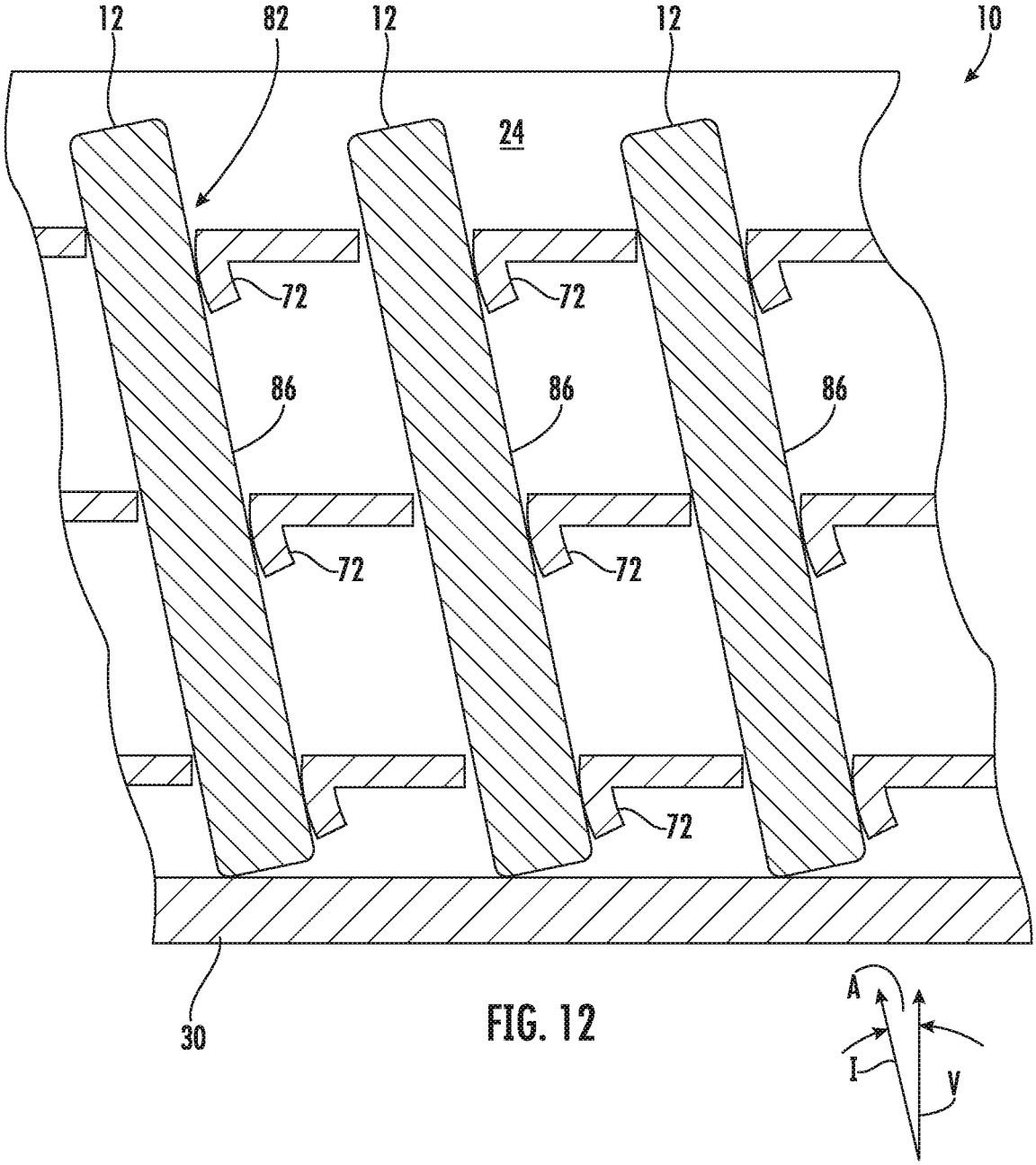
FIG. 12 is generally similar to FIG. 11, except, for example, for depicting that the receptacles and articles can be inclined, in accordance with an embodiment of this disclosure.

Referring to FIGS. 11 and 12, when the engagement tabs, fingers, flaps 72, or the like, are included, they can be configured to relatively softly engage the slabs 12 (e.g., the decorate faces 86) in a manner that seeks to avoid damaging the decorative faces 86. As another example, in FIG. 12 the receptacles 82 are inclined so that gaps are defined between the crate's base 30 and the lower edges of the decorative faces 86 in a manner that seeks to avoid damaging the lower edges of the decorative faces 86.

Referring to the embodiment depicted in FIG. 12, the upright direction can be vertical V and the inclined direction I can be inclined relative to vertical by an angle A of at least about 5 degrees, at least about 10 degrees, about 20 degrees, less than about 45 degrees (e.g., in a range of from about 0 to about 45 degrees), less than about 33 degrees (e.g., in a range of from about 0 to about 33 degrees), less than about 25 degrees (e.g., in a range of from about 0 to about 25 degrees), or any subranges or values therebetween. In other embodiments, the angle A (see, e.g., FIG. 12) can be about zero. The magnitude of the angle A (FIG. 12) may depend upon multiple factors that may be adjusted (e.g., "tuned") for performance and/or economic purposes.

At least partially reiterating from above, in the example depicted in FIG. 1, each of the partitions 16 has 26 holes 20 that are each configured to receive an article 12, such that the crate apparatus 10 has 26 receptacles 82 for respectively receiving 26 articles. Similarly, in the example depicted in FIGS. 2 and 4, each of the partitions 16 has 40 holes 20 that are each configured to receive an article 12, such that the crate apparatus 10 has 40 receptacles 82 for respectively receiving 40 articles. More generally and in accordance with some of the embodiments of this disclosure, the number of article-receiving holes 20 per partition 16 and the number of article-receiving receptacles 82 per crate apparatus 10 can be, for example, at least one, one or more, at least two, in a range of from one to a hundred, at least five, in a range of from five to seventy-five, at least ten, in a range of from ten to fifty, or any subranges or values therebetween. Even more generally, there can be any suitable number of article-receiving holes 20 per partition 16 and any suitable number of article-receiving receptacles 82 per crate apparatus 10 depending upon various factors, including the configuration (e.g., size) of the crate 14 and the configuration (e.g., size) of article(s), and the configurations of the various components of the crate apparatus 10 can be adjusted accordingly.

A wide variety of configurations and dimensional ratios are within the scope of this disclosure, for adapting to a variety of differently dimensioned containers (e.g., crates 14) and articles (e.g., slabs 12). That said, some specific examples of ratios are provided in the following, in accordance with some of the embodiments of this disclosure The partitions 16 may be referred to as packaging material, and the crate assemblies 10 can be capable of providing sufficient protection to the articles 12 with a relatively small cost of packaging material. In this regard, the ratio between the number of partitions 16 and the number of receptacles 82 or articles 12 in a crate apparatus 10 can be, for example, 2:5, 3:10, 3:26, 3:40, or any values or subranges therebetween. More generally, the ratios between partitions 16 and receptacles 82 or articles 12 in a crate apparatus 10 can be expressed as percentages (e.g., number of partitions 16 divided by number of articles 12), for example about 40%, less than 40%, about 30%, less than 30%, about 20%, less than 20%, about 15%, less than 15%, about 12%, less than 12%, about 10%, less than 10%, about 7%, less than 7%, about 5%, less than 5%, or any values or subranges therebetween. As another example, ratios between receptacles 82 or articles 12 versus partitions 16 in a crate apparatus 10 can be expressed as percentages (e.g., number of receptacles 82 divided by number of partitions 16), for example about 60%, greater than 60%, about 70%, greater than 70%, about 75%, greater than 75%, about 80%, greater than 80%, about 85%, greater than 85%, about 88%, greater than 88%, about 90%, greater than 90%, about 93%, greater than 93%, or any values or subranges therebetween.

As an example for the embodiments depicted in the drawings, each of the articles or slabs 12 is a rectangular block having a length and width that are each larger than the thickness of the block. For example, the slabs 12 can be formed utilizing a mold having rectangular cavities. For forming the decorative faces 86, the mold cavities can be painted or otherwise coated with a pigmented slurry including water, cement, colorant(s), and a polymeric binder. Concrete can be supplied into the cavities over the pigmented slurry. Optionally one or more intermediate layers can be included between the pigmented slurry and the concrete, and/or the articles or slabs can be formed in any other suitable manner. Numerous variations are within the scope of this disclosure. For example, a variety of differently configured (e.g., sized and shaped) holes 20, receptacles 82, articles (e.g., slabs 12), and/or the like, are within the scope of this disclosure. For example, it is believed that other examples of the articles 12 can include sheets of glass, mirrors, pictures, interior door panels for automobiles, or other articles that may benefit by being stored, shipped, or displayed in the apparatuses of this disclosure (see, e.g., apparatus 10).

Other examples of variations can relate to the optional engagement flaps 72. For example and reiterating from above, the engagement flaps 72 may be of any suitable configuration (e.g., size and shape) and can be customized to specific articles 12 to balance holding the articles in place versus restricting (e.g., avoiding) damage to the decorative faces 86. As another example, the passageways 52 can extend in the lengthwise direction of the engagement flaps 72 for causing the engagement flaps to engage the articles 12 with a relatively greater force. As another example, the passageways 52 can extend in the widthwise direction of the engagement flaps 72 for causing the engagement flaps to engage the articles 12 with a relatively lesser force, which may optionally be desirable if necessary or helpful for reducing any damage to the decorate faces 86. Alternatively or additionally, the performance characteristics of the partitions 16 (e.g., any engagement flaps 72 and/or other features) of the crate apparatus 10 may depend upon multiple factors that may be adjusted (e.g., "tuned") for performance and/or economic purposes. Optionally, engagement flaps 72 can extend inwardly from both or each of the opposite sides of a hole or slot 20.

Figure 13:
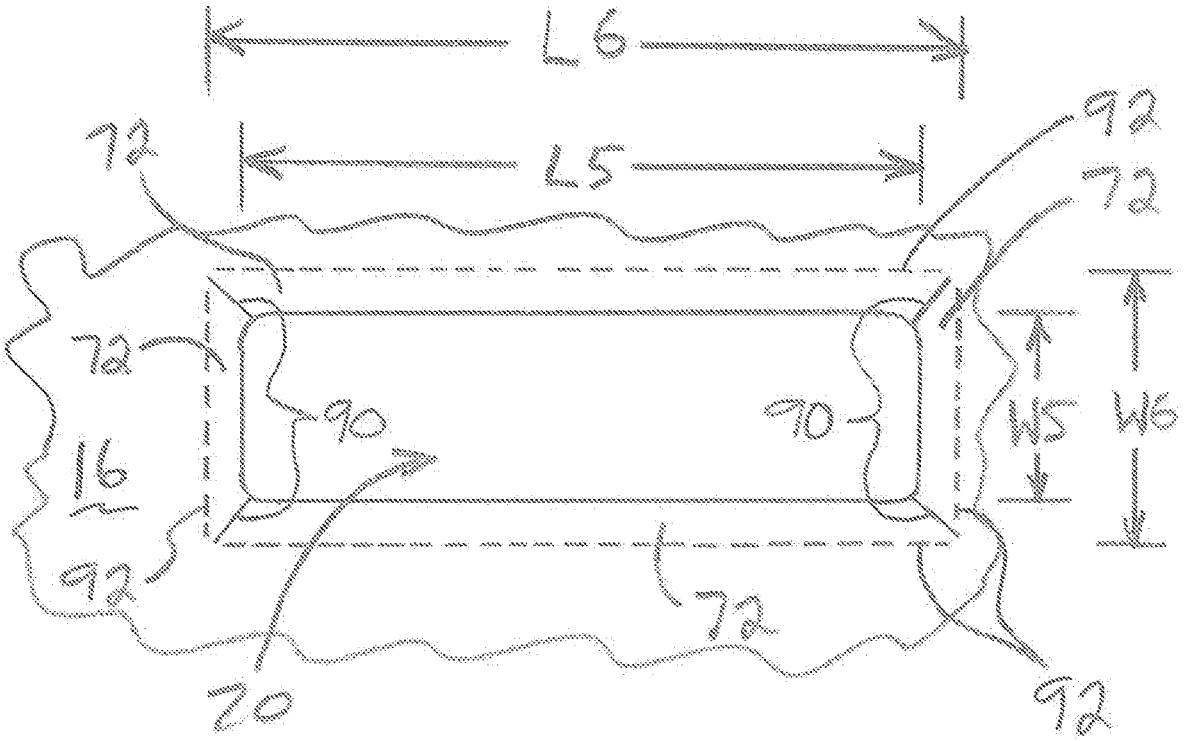
FIG. 13 is similar to FIG. 6, except for further depicting a different configuration of engagement flaps that can extend into and/or at least partially define the apertures, in accordance with an embodiment of this disclosure.

Referring to FIG. 13, and at least partially reiterating from above, optionally the partitions 16 can include one or more engagement flaps 72 that protrude into, define, or are otherwise associated with, the holes or slots 20, so that at least some of, a majority of, or each of the holes is initially at least partially defined by one or more engagement flaps. In the example depicted in FIG. 13, the representative hole or slot 20 is defined by the inner edges of engagement flaps 72 that are at least partially defined by cuts 90 (e.g., slits) respectively extending outwardly from the corners of the slot. In the example depicted in FIG. 13, while the flaps 72 are coplanar with adjacent portions of the partition 16, the hole or slot 20 can have a relatively small width W5 and a relatively small length L5. In contrast, while the engagement flaps 72 are perpendicular to adjacent portions of the partition 16, the hole or slot 20 can have a relatively large width W6 and a relatively large length L6.

At least partially reiterating from above, the cut edges of the engagement flaps 72 can be formed, for example, by thermally cutting, laser cutting, die cutting, and/or in any other suitable manner. In one specific example and optionally, one or more of, or each of, the cut edges of the engagement flaps 72 can be relatively smooth and/or rounded as compared to an unsealed edge of the precursor sheets or panels from which the blanks 50 are typically formed. More specifically and for each partition 16, the forming of the relatively smooth and/or rounded edges of the engagement flaps 72 can include closing at least some of, the majority of, or each of the ends of the interior passageways 52 that would otherwise be open at a cut edge of the engagement flap. Those ends of the interior passageways 52 can be at least partially closed or closed (e.g., hermetically sealed closed) to at least partially form sealed edges by substantially simultaneously applying thereto both heat and mechanical pressure, wherein the heating can be provided, for example, by way of heat transfer, ultrasonic energy, electron beam(s), laser beam(s), and/or any other suitable techniques.

In the example depicted in FIG. 13, inner edges of the engagement flaps 72 can be defined by one or more lines of disruption that may be in the form of fold lines 92 that foldably or pivotably connect the engagement flaps to respective portions of the associated partition 16. In one specific example, one or more of, a majority of, or each of the lines of disruption 92 can be a mechanically formed score line that is formed without using thermal energy, so that the engagement flaps 72 function like, or similar to, springs that are biased toward a coplanar configuration with the remainder of the associated partition 16. The engagement flaps 72 can be configured to function as fingers or tabs that function as soft springs that help to hold an associated article (e.g., artificial stone slab 12) in place within the associated hole 20, receptacle 82 (see, e.g., FIG. 7), or the like. Alternatively, the fold lines or lines of disruption 92 may not be formed in the flat blank 50. Rather, the lines of disruption 92 may be formed while (e.g., in response to) at least one article (e.g., artificial stone slab 12) being engaged against the associated engagement(s) flap 72 while the article is being inserted through the associated hole 20. As other examples, the lines of disruption (e.g., fold lines 92) that may be associated with (e.g., at least partially define) the engagement flaps 72 can be formed by simultaneously applying heat and mechanical pressure (e.g., crimping and/or scoring) at the line of disruption. The heat can be provided, for example, by way of heat transfer, ultrasonic energy, electron beam(s), laser beam(s), and/or any other suitable techniques. More generally, the lines of disruption 92 can be formed by applying mechanical force or pressure and/or by thermally heating in a variety of ways.

With continued reference to FIG. 13 and for example, the hole's initial width W5 can be smaller than the thickness T (FIGS. 8 and 9) of the article or slab 12 received in the hole 20 by about 2 mm to about 60 mm (and it is believed that the values recited in this sentence can vary, for example, by plus or minus 5%, plus or minus 10%, plus or minus 15%, plus or minus 20%, plus or minus 25%, or any subranges or values therebetween) so that respective engagement flaps 72 pivot in response to the article or slab being pushed into or otherwise traveling into the hole. Similarly, the hole's initial length L5 can be smaller than the width W4 (FIG. 9) of the article or slab 12 received in the hole 20 by about 2 mm to about 60 mm (and it is believed that the values recited in this sentence can vary, for example, by plus or minus 5%, plus or minus 10%, plus or minus 15%, plus or minus 20%, plus or minus 25%, or any subranges or values therebetween) so that respective engagement flaps 72 pivot in response to the article or slab being pushed into or otherwise traveling into the hole. In the example depicted in FIG. 13, each side of the hole 20 includes and/or is defined by an engagement flap 72. More generally, any suitable number and arrangement of the engagement flaps 72 can be included. When there are engagement flap(s) 72 only at one side of the hole 20, then the article's or slab's decorative face 86 would typically be engaged against those engagement flap(s). When there are engagement flap(s) 72 only at three sides of the hole 20, then the article's or slab's decorative face 86 and adjacent sides would typically be respectively engaged against those engagement flap(s) (e.g., there may not be any flaps for engaging the back side of the article or slab 12). The holes 20 and engagement flaps 72 may be of any suitable size and shape and can be customized to specific articles 12 to balance holding the articles in place versus avoiding damage to the decorative faces 86.

A wide variety of configurations and dimension are within the scope of this disclosure, for adapting to a variety of differently dimensioned containers (e.g., crates 14) and articles (e.g., slabs 12). That said, some specific examples of dimensions are provided in the following, in accordance with some of the embodiments of this disclosure.

Referring to FIG. 3, the precursor sheets from which the blanks 50 can be formed, and, thus, the blanks 50, can have a thickness T of at least about 2 mm, a thickness of at least about 2.5 mm, a thickness of at least about 3.0 mm, or any subranges or values therebetween. As another example, the precursor sheets from which the blanks 50 can be formed, and, thus, the blanks 50, can have a thickness T in a range of from about 3 mm to about 4 mm, and it is believed that the values recited in this sentence can vary, for example, by plus or minus 5%, plus or minus 10%, plus or minus 15%, plus or minus 20%, plus or minus 25%, or any subranges or values therebetween. The partitions 16 can have a length of about 45 inches, a width of about 36 inches, and it is believed that the values recited in this sentence can vary, for example, by plus or minus 5%, plus or minus 10%, plus or minus 15%, plus or minus 20%, plus or minus 25%, or any subranges or values therebetween. In the example depicted in FIG. 4, there are 2 rows of 20 holes 20, wherein the rows extend in the lengthwise direction of the partition 16. There can be different numbers of rows and different numbers of holes 20 in the rows, and the rows can extend in the crosswise or other suitable directions of the partition 16.

Referring to FIGS. 5 and 6, the holes' widths W1 and W2 can be at least about 0.5 inches or at least about 1 inch, or any subranges or values therebetween; and the lengths L1 and L2 can be at least about 1 inch, at least about 3.5 inches or at least about 6 inches, or any subranges or values therebetween. Referring to FIG. 5 and as another example: the holes' widths W1 can be about, or at least about 1.1875 inches; the holes' lengths L1 can be about, or at least about 12.125 inches; and it is believed that the values recited in this sentence can vary, for example, by plus or minus 5%, plus or minus 10%, plus or minus 15%, plus or minus 20%, plus or minus 25%, or any subranges or values therebetween. Referring to FIG. 6 and as another example: the holes' widths W2 can be about, or at least about 1.1250 inches; the holes' lengths L2 can be about, or at least about 12.125 inches; the engagement flaps' lengths L3 can be in a range of from about 0.5 inches to about 0.75 inches; the engagement flaps' widths W3 can be about 0.95 inches; the gaps G can be about 0.5 inches; and it is believed that the values recited in this sentence can vary, for example, by plus or minus 5%, plus or minus 10%, plus or minus 15%, plus or minus 20%, plus or minus 25%, or any subranges or values therebetween.

Referring to FIGS. 8 and 9, the slabs' thicknesses T can be at least about 0.5 inches or at least about 1 inch, or any subranges or values therebetween; the slabs' widths W can be at least about 1 inch, at least about 3.5 inches or at least about 6 inches, or any subranges or values therebetween; and the slabs lengths L can be at least about 6 inches or at least about 9 inches, or any subranges or values therebetween; and the decorative faces 86 can have a surface area of at least about 27 square inches. As another example, the slabs' thicknesses T can be about 1 inch, the slabs' widths W can be about 12 inches, the slabs' lengths L can be about 24 inches, and it is believed that the values recited in this sentence can vary by plus or minus 5%, plus or minus 10%, plus or minus 15%, plus or minus 20%, plus or minus 25%, or any subranges or values therebetween. In the crate apparatus 10 loaded with slabs 20, adjacent slabs are typically spaced apart by about 1 inch, and it is believed that the values recited in this sentence can vary by plus or minus 5%, plus or minus 10%, plus or minus 15%, plus or minus 20%, plus or minus 25%, or any subranges or values therebetween.

Reiterating from above, it is within the scope of this disclosure for one or more of the terms "substantially," "about," "approximately," and/or the like, to qualify each of the adjectives and adverbs of the foregoing disclosure, for the purpose of providing a broad disclosure. As an example, it is believed that those of ordinary skill in the art will readily understand that, in different implementations of the features of this disclosure, reasonably different engineering tolerances, precision, and/or accuracy may be applicable and suitable for obtaining the desired result. Accordingly, it is believed that those of ordinary skill will readily understand usage herein of the terms such as "substantially," "about," "approximately," and the like. As another example, variations may be introduced when the blanks 50 are manufactured by passing a web of precursor material through one or more die stations including cutting and scoring dies, or the like. For example, variations may occur as dies wear and/or are replaced, or the like. Those of ordinary skill in the art will understand that, in such a manufacturing process, typically there are engineering tolerances comprising permissible limits in variations of dimensions, and the tolerances can vary in different circumstances. Accordingly, it is believed that those of ordinary skill will readily understand usage herein of the terms such as "substantially," "about," "approximately," and the like.

In the specification and drawings, examples of embodiments have been disclosed. The present invention is not limited to such exemplary embodiments. The use of the term "and/or" includes any and all combinations of one or more of the associated listed items. Unless otherwise noted, specific terms have been used in a generic and descriptive sense and not for purposes of limitation.

What is claimed is:

1. A crate apparatus for at least partially containing and protecting artificial stone slabs, the crate apparatus comprising:

a crate comprising a base, and a plurality of side structures extending upwardly from the base, wherein the plurality of side structures extends at least partially around an interior of the crate;

a partition at least partially positioned in the interior of the crate, wherein:

the partition is spaced apart from an upper surface of the base in an upright direction so that a gap is defined between a lower surface of the partition and the upper surface of the base, the partition is spaced apart from a top of the crate in the upright direction so that a gap is defined between an upper surface of the partition and the top of the crate, the partition extends crosswise to the upright direction; and a plurality of holes extending through the partition, wherein:

for each hole of at least some of the plurality of holes, the hole has first and second dimensions extending crosswise to one another and across the hole so that the hole is configured to have at least one artificial stone slab extend through the hole, the first dimension is at least about 0.5 inches, and the second dimension is at least about 1 inch, wherein holes of the plurality of holes are cooperatively configured to at least partially define a plurality of receptacles of the crate apparatus that are configured for respectively receiving artificial stone slabs, and the receptacles extend above and below the partition, and wherein the partition comprises an extruded, polymeric panel comprising a plurality of interior passageways.

2. The crate apparatus of claim 1, wherein the partition is suspended in the interior of the crate.

3. The crate apparatus of claim 1, wherein the base includes horizontally extending receptacles defined between wooden boards of the base and configured to receive prongs of a lifting mechanism.

4. The crate apparatus of claim 1, wherein:

the plurality of holes is a plurality of slots; and slots of the plurality of slots partially define respective receptacles of the plurality of receptacles.

5. The crate apparatus of claim 4, wherein lower ends of receptacles of the plurality of receptacles are at least partially defined by an upper surface of a wooden board of the base.

6. The crate apparatus of claim 1, wherein:

the partition is a first partition;

the crate apparatus comprises a second partition mounted so that the second partition is at least partially positioned in the interior of the crate;

the second partition is spaced apart from the upper surface of the first partition in the upright direction so that a gap is defined between a lower surface of the second partition and the upper surface of the first partition;

the second partition extends crosswise to the upright direction;

a plurality of holes extend through the second partition;

for each hole of at least some of the plurality of holes extending through the second partition:

the hole has first and second dimensions extending crosswise to one another and across the hole so that the hole is configured to have at least one artificial stone slab extend through the hole, the first dimension is at least about 0.5 inches, and the second dimension is at least about 1 inch; and holes of the plurality of holes of the second partition partially define the plurality of receptacles for respectively receiving artificial stone slabs.

7. The crate apparatus of claim 6, comprising a third partition mounted so that the third partition is at least partially positioned in the interior of the crate, wherein:

the third partition is spaced apart from an upper surface of the second partition in the upright direction so that a gap is defined between a lower surface of the third partition and the upper surface of the second partition;

the third partition extends crosswise to the upright direction;

a plurality of holes extend through the third partition;

for each hole of at least some of the plurality of holes extending through the third partition:

the hole has first and second dimensions extending crosswise to one another and across the hole so that the hole is configured to have at least one artificial stone slab extend through the hole, the first dimension is at least about 0.5 inches, and the second dimension is at least about 1 inch; and holes of the plurality of holes of the third partition partially define the plurality of receptacles for respectively receiving artificial stone slabs.

8. A crate apparatus for at least partially containing and protecting artificial stone slabs, the crate apparatus comprising:

a crate comprising a base, and a plurality of side structures extending upwardly from the base, wherein the plurality of side structures extends at least partially around an interior of the crate;

a partition at least partially positioned in the interior of the crate, wherein:

the partition is spaced apart from an upper surface of the base in an upright direction so that a gap is defined between a lower surface of the partition and the upper surface of the base, the partition is spaced apart from a top of the crate in the upright direction so that a gap is defined between an upper surface of the partition and the top of the crate, the partition extends crosswise to the upright direction; and a plurality of holes extending through the partition, wherein:

for each hole of at least some of the plurality of holes, the hole has first and second dimensions extending crosswise to one another and across the hole so that the hole is configured to have at least one artificial stone slab extend through the hole, the first dimension is at least about 0.5 inches, the second dimension is at least about 1 inch, holes of the plurality of holes are cooperatively configured to at least partially define a plurality of receptacles of the crate apparatus that are configured for respectively receiving artificial stone slabs, and the receptacles extend above and below the partition, wherein the crate apparatus is in combination with a plurality of artificial stone slabs, and at least some of the artificial stone slabs:

extend upright, respectively extend through at least some holes of the plurality of holes, and are respectively positioned in at least some receptacles of the plurality of receptacles.

9. The combination of claim 8, wherein the partition comprises an extruded, polymeric panel comprising a plurality of interior passageways.

10. A crate apparatus for at least partially containing and protecting artificial stone slabs, the crate apparatus comprising:

a crate comprising a base, and a plurality of side structures extending upwardly from the base, wherein the plurality of side structures extends at least partially around an interior of the crate;

a partition at least partially positioned in the interior of the crate, wherein:

the partition is spaced apart from an upper surface of the base in an upright direction so that a gap is defined between a lower surface of the partition and the upper surface of the base, the partition is spaced apart from a top of the crate in the upright direction so that a gap is defined between an upper surface of the partition and the top of the crate, the partition extends crosswise to the upright direction:

a plurality of holes extending through the partition, wherein:

for each hole of at least some of the plurality of holes, the hole has first and second dimensions extending crosswise to one another and across the hole so that the hole is configured to have at least one artificial stone slab extend through the hole, the first dimension is at least about 0.5 inches, the second dimension is at least about 1 inch, holes of the plurality of holes are cooperatively configured to at least partially define a plurality of receptacles of the crate apparatus that are configured for respectively receiving artificial stone slabs, and the receptacles extend above and below the partition; and upwardly extending flaps respectively connected to the partition by lines of disruption, wherein the flaps are respectively connected to sidewalls of the crate.

11. The crate apparatus of claim 10, wherein:

the partition comprises an extruded, polymeric panel comprising a plurality of interior passageways extending in a direction; and at least one flap of the flaps comprises an extruded, polymeric panel comprising a plurality of interior passageways extending in the direction.

12. The crate apparatus of claim 10, wherein the partition comprises an extruded, polymeric panel comprising a plurality of interior passageways.

13. A crate apparatus for at least partially containing and protecting artificial stone slabs, the crate apparatus comprising:

a crate comprising a base, and a plurality of side structures extending upwardly from the base, wherein the plurality of side structures extends at least partially around an interior of the crate; and a plurality of partitions mounted to the crate and at least partially positioned in the interior of the crate, wherein:

the plurality of partitions extend crosswise to, and are spaced apart from one another in, an upright direction, the plurality of partitions are cooperatively configured to at least partially define a plurality of upright receptacles for respectively receiving artificial stone slabs, and for each receptacle of at least some of the plurality of receptacles, the receptacle is at least partially defined by both a hole of a first partition of the plurality of partitions, and a hole of a second partition of the plurality of partitions, the hole of the first partition and the hole of the second partition are spaced apart from one another in the upright direction, the hole of the first partition and the hole of the second partition are at least partially aligned with one another, and the first partition comprises an extruded, polymeric panel comprising a plurality of interior passageways.

14. The crate apparatus of claim 13, wherein there are at least 75% more of the receptacles in the crate than there are the partitions in the crate.

15. The crate apparatus of claim 13, wherein lower ends of receptacles of the plurality of receptacles are at least partially defined by at least one upper surface of the base.

16. The crate apparatus of claim 13, wherein the respective holes that at least partially define the receptacle are aligned in, and spaced apart from one another in, the upright direction.

17. The crate apparatus of claim 16, wherein:

the upright direction is a vertical direction; and a lower end of the receptacle is at least partially defined by at least one upper surface of the base.

18. The crate apparatus of claim 13, wherein:

the upright direction is vertical;

the respective holes that at least partially define the receptacle are aligned in an inclined direction; and the inclined direction is inclined relative the upright direction.

19. The crate apparatus of claim 18, wherein the inclined direction is inclined relative the upright direction by less than forty-five degrees.

20. The crate apparatus of claim 13, wherein the second partition comprises an extruded, polymeric panel comprising a plurality of interior passageways.

* * * * *